US009360201B2

(12) United States Patent
Chou et al.

(10) Patent No.: US 9,360,201 B2
(45) Date of Patent: Jun. 7, 2016

(54) LIGHTING DEVICE

(71) Applicant: DBM REFLEX OF TAIWAN CO., LTD., Tainan (TW)

(72) Inventors: Min-Hwa Chou, Tainan (TW); Yin-Chen Huang, Tainan (TW)

(73) Assignee: DBM REFLEX OF TAIWAN CO., LTD., Tainan (TW)

( * ) Notice: Subject to any disclaimer, the term of this patent is extended or adjusted under 35 U.S.C. 154(b) by 241 days.

(21) Appl. No.: 14/254,180

(22) Filed: Apr. 16, 2014

(65) Prior Publication Data

US 2015/0300618 A1 Oct. 22, 2015

(51) Int. Cl.

| | |
|---|---|
| ***F21V 29/503*** | (2015.01) |
| ***F21K 99/00*** | (2016.01) |
| ***F21V 29/71*** | (2015.01) |
| ***F21S 8/10*** | (2006.01) |
| *F21Y 101/02* | (2006.01) |

(52) U.S. Cl.

CPC ..... *F21V 29/503* (2015.01); *F21K 9/30* (2013.01); *F21S 48/212* (2013.01); *F21S 48/217* (2013.01); *F21S 48/328* (2013.01); *F21V 29/713* (2015.01); *F21Y 2101/02* (2013.01)

(58) Field of Classification Search

CPC ..... F21V 29/503; F21V 29/713; F21K 9/30; F21S 48/212; F21S 48/217; F21S 48/328

See application file for complete search history.

(56) References Cited

U.S. PATENT DOCUMENTS

2013/0077311 A1* 3/2013 Kinnune ..... F21V 15/015 362/249.02

* cited by examiner

*Primary Examiner* — Mary Ellen Bowman

(74) *Attorney, Agent, or Firm* — Tracy M. Heims; Apex Juris, pllc.

(57) ABSTRACT

A lighting device for a vehicle lamp has a base, a substrate, a conducting rib and an LED module. The substrate is mounted in the base. The conducting rib is perpendicularly mounted on the base and has a first heat-dissipating surface and a second heat-dissipating surface opposite to the first heat-dissipating surface. The conducting rib provides two heat dissipating paths to increase the heat dissipating efficiency. The LED module is mounted on a distal end of the conducting rib and extends out of the base, and the LED module is electrically connected to the substrate. The LED module extends out of the base to accurately correspond to a reflection space around a lamp seat and improve the light-homogenizing effect of the vehicle lamp.

17 Claims, 5 Drawing Sheets

LIGHTING DEVICE

BACKGROUND OF THE INVENTION

1. Field of the Invention

The present invention relates to a lighting device, and more particularly to a lighting device for a vehicle lamp to provide a light-homogenizing effect.

2. Description of Related Art

An LED (light emitting diode) is a point light source and has small volume and high luminance. Therefore, LED has been widely used in vehicle lamps. A vehicle lamp has a seat, a conventional lighting device, and a lampshade. A chamber is defined in the seat. An opening is formed in the seat and communicates with the chamber. The conventional lighting device is mounted on the seat. The lampshade is mounted on the seat and closes the opening of the seat. The conventional lighting device has a base, a substrate, an LED module and a heat sink. The substrate is mounted on the base. The LED module is mounted on a distal end of the substrate and has a circuit board and an LED. The circuit board is connected to the substrate. The LED is mounted on the circuit board. The heat sink is mounted on a side surface of the substrate.

Heat generated by the LED is conducted through the circuit board, the substrate and the heat sink in sequence to form a single heat dissipating path. Thus, the heat dissipating efficiency of the conventional lighting device is not sufficient.

To overcome the shortcomings, the present invention tends to provide a lighting device to mitigate or obviate the aforementioned problems.

SUMMARY OF THE INVENTION

The main objective of the invention is to provide a lighting device with improved heat dissipating efficiency.

The lighting device for a vehicle lamp has a base, a substrate, a conducting rib and an LED module. The substrate is mounted in the base. The conducting rib is perpendicularly mounted on the base and has a first end, a second end, a first heat-dissipating surface, and a second heat-dissipating surface. The second end is opposite to the first end and is connected to the base. The second heat-dissipating surface is opposite to the first heat-dissipating surface. The LED module is mounted on the first end of the conducting rib and extends out of the base, and is electrically connected to the substrate.

Heat generated by the LED module is conducted to the conducting rib, and then the heat is conducted out of the first heat-dissipating surface and the second heat-dissipating surface, so the conducting rib provides two heat dissipating paths to increase the heat dissipating efficiency. Furthermore, the lighting device is mounted in a vehicle lamp. The LED module is mounted on the first end of the conducting rib to accurately correspond to a reflection space of a lamp seat of the vehicle lamp. Therefore, the light emitted from the LED module illuminates a reflecting surface of the lamp seat and is reflected by the reflecting surface to improve the light-homogenizing effect of the vehicle lamp. So the lighting device as described is suitable for various types of lamps and is in conformity with regulations of luminance and distribution of light pattern of vehicle lamps.

Other objects, advantages and novel features of the invention will become more apparent from the following detailed description when taken in conjunction with the accompanying drawings.

DETAILED DESCRIPTION OF PREFERRED EMBODIMENT

Figure 1:
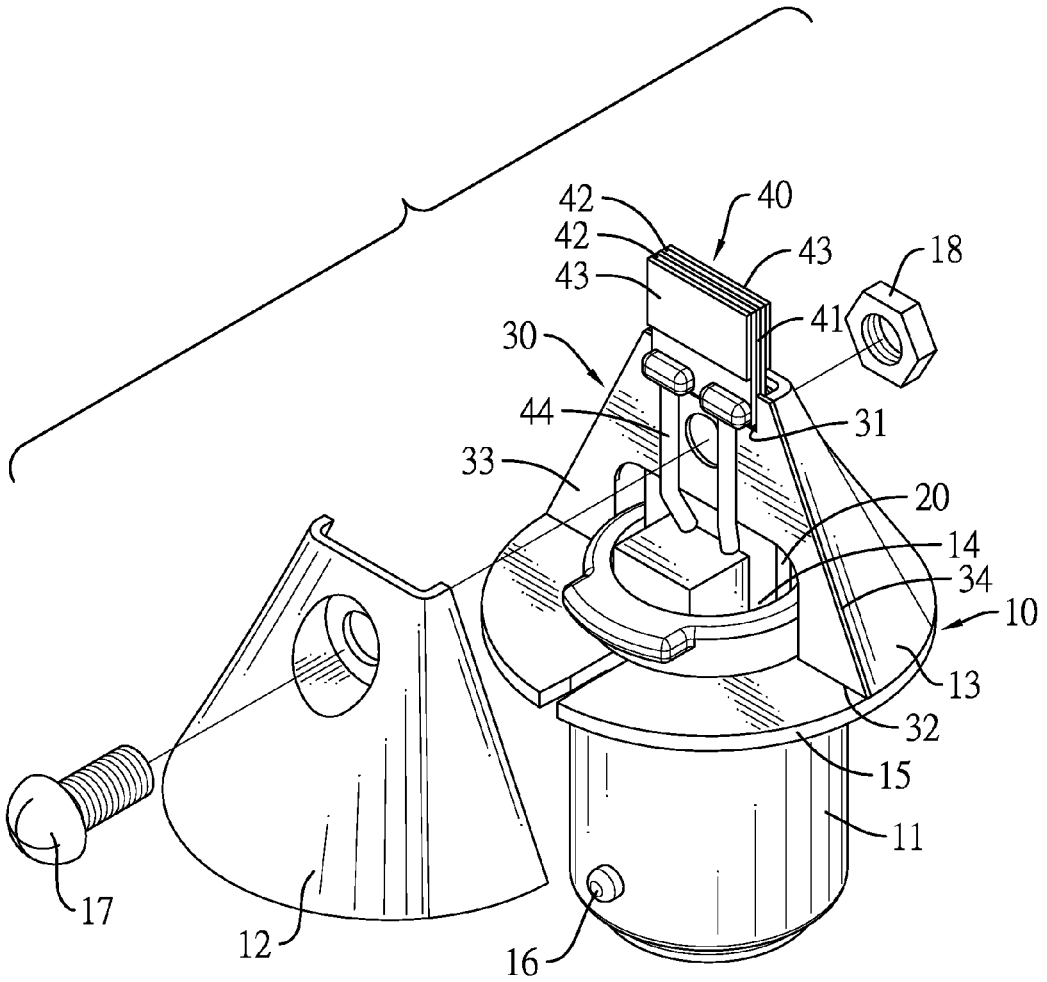
FIG. 1 is an exploded perspective view of a first embodiment of a lighting device in accordance with the present invention.
Figure 2:
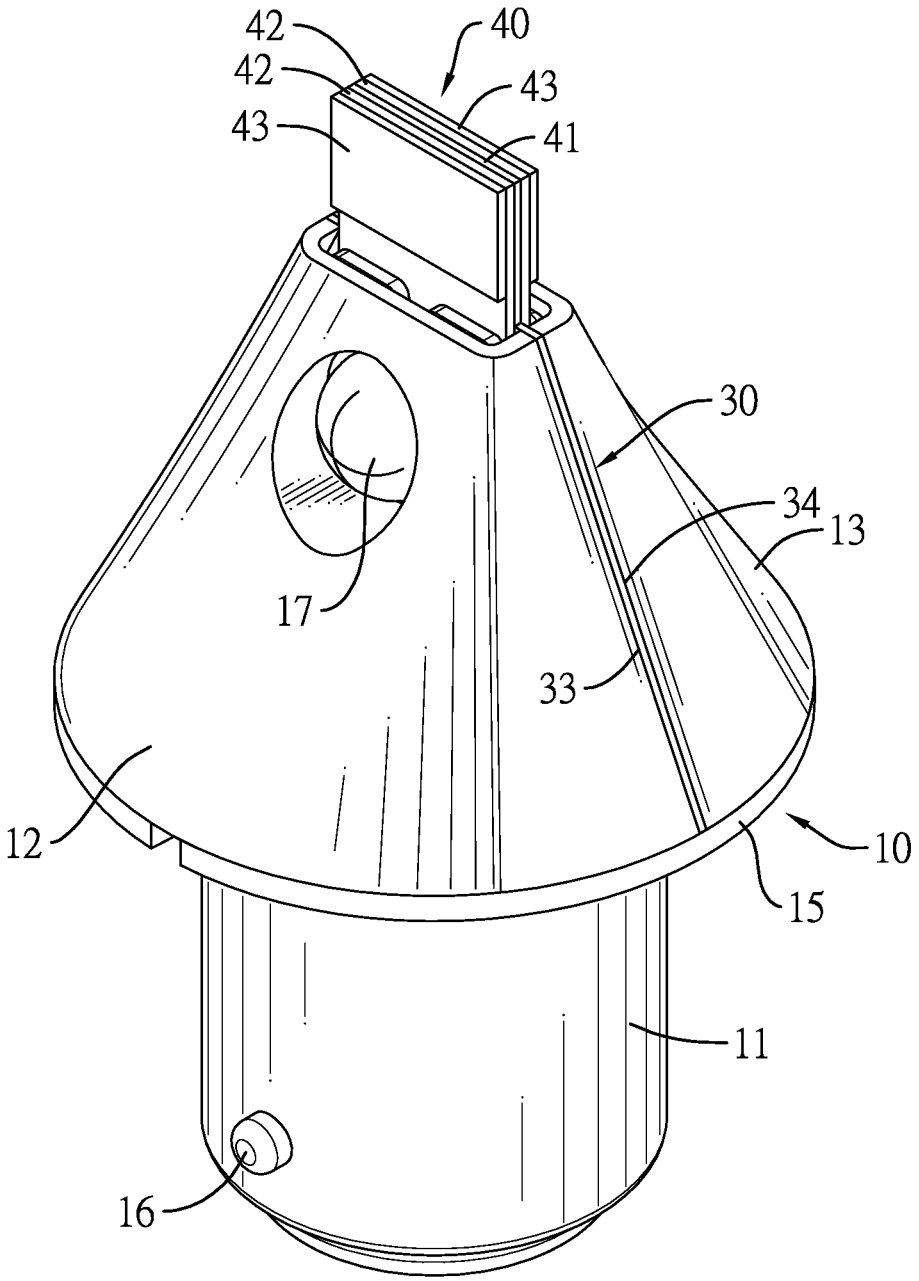
FIG. 2 is a perspective view of the lighting device in FIG. 1.
Figure 3:
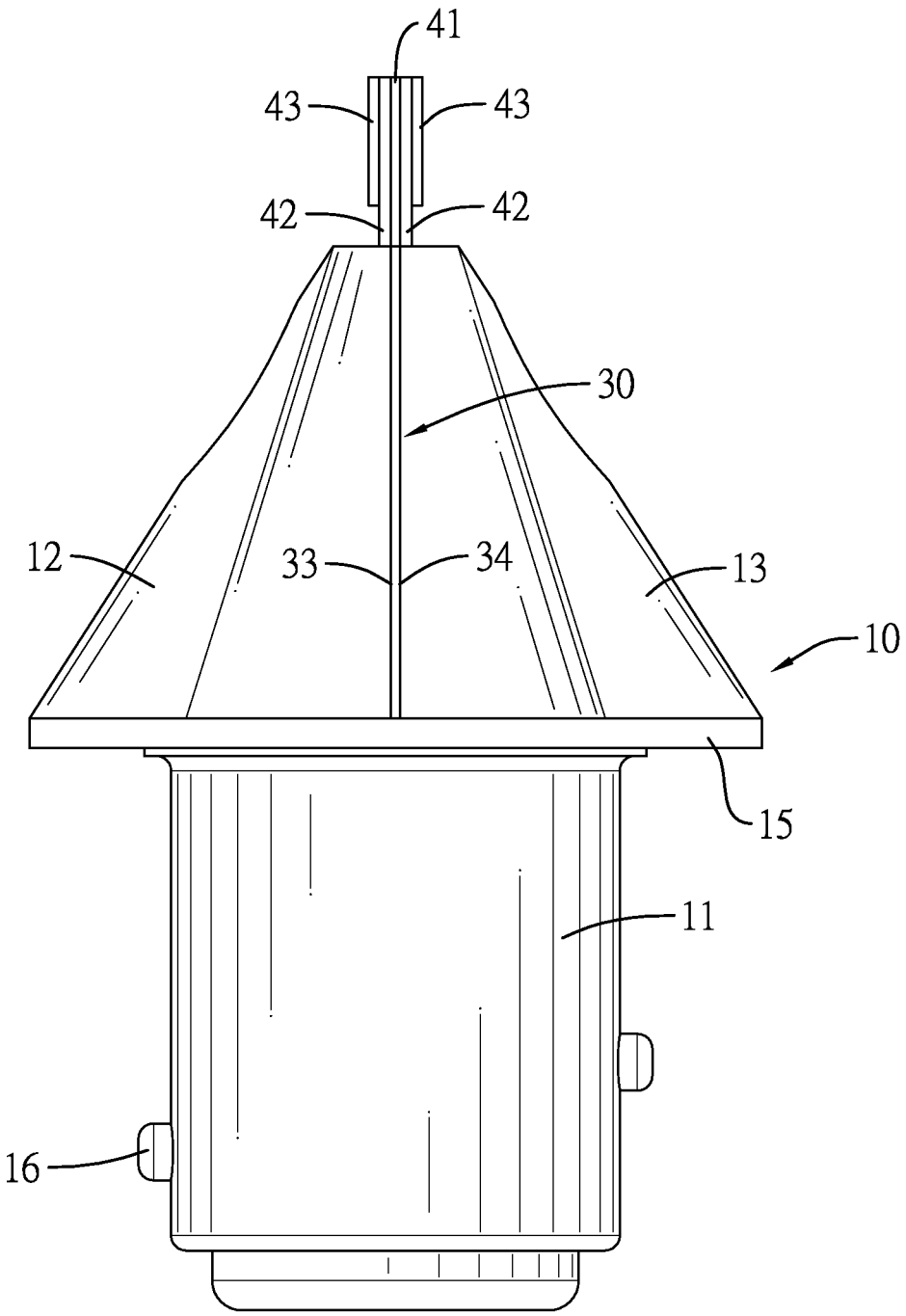
FIG. 3 is a side view of the lighting device in FIG. 2.

With reference to FIGS. 1 to 3, a lighting device in accordance with the present invention comprises a base 10, a substrate 20, a conducting rib 30 and an LED module 40.

The base 10 has a seat 11, a loading portion 15, a first cap 12, a second cap 13 and multiple protrusions 16. The seat 11 has an inner space 14 formed therein. The loading portion 15 is mounted around and protrudes transversely from the seat 11. The first cap 12 and the second cap 13 are both mounted on the loading portion 15. The protrusions 16 are formed on an outer surface of the seat 11.

The substrate 20 is mounted in the base 10 and is located at the inner space 14 of the seat 11.

The conducting rib 30 is perpendicularly mounted on the loading portion 15 of the base 10 and has a first end 31, a second end 32, a first heat-dissipating surface 33, and a second heat-dissipating surface 34. The second end 32 is opposite to the first end 31 and is connected to the loading portion 15 of the base 10. The first heat-dissipating surface 33 is connected to the first cap 12. The second heat-dissipating surface 34 is opposite to the first heat-dissipating surface 33 and is connected to the second cap 13. Preferably, the conducting rib 30 is made of copper or ceramics.

The LED module 40 is mounted on the first end 31 of the conducting rib 30, extends out of the base 10, and is electrically connected to the substrate 20. The LED module 40 has a heat-conducting plate 41, at least one circuit board 42, and at least one LED 43. The heat-conducting plate 41 is mounted on the first end 31 of the conducting rib 30 and has two sides. Each circuit board 42 is mounted on one of the two sides of the heat-conducting plate 41 and is electrically connected to the substrate 20 by an electric wire 44. Each LED 43 is mounted on and is connected electrically to a corresponding circuit board 42. In the preferred embodiment as shown in FIG. 3, the LED module 40 has two circuit boards 42 mounted respectively on the two sides of the heat-conducting plate 41 and two LEDs 43 respectively mounted on the two circuit boards 42.

One of the ways to assemble the first and second caps 12, 13 is to use a screw 17 and a nut 18. With reference to FIG. 1, the screw 17 is inserted through the first cap 12, the conducting rib 30 and the second cap 13. The nut 18 is fastened on the screw 17. Alternatively, the lighting device as described may have engaging units to assemble the first cap 12 with the second cap 13.

Figure 5:
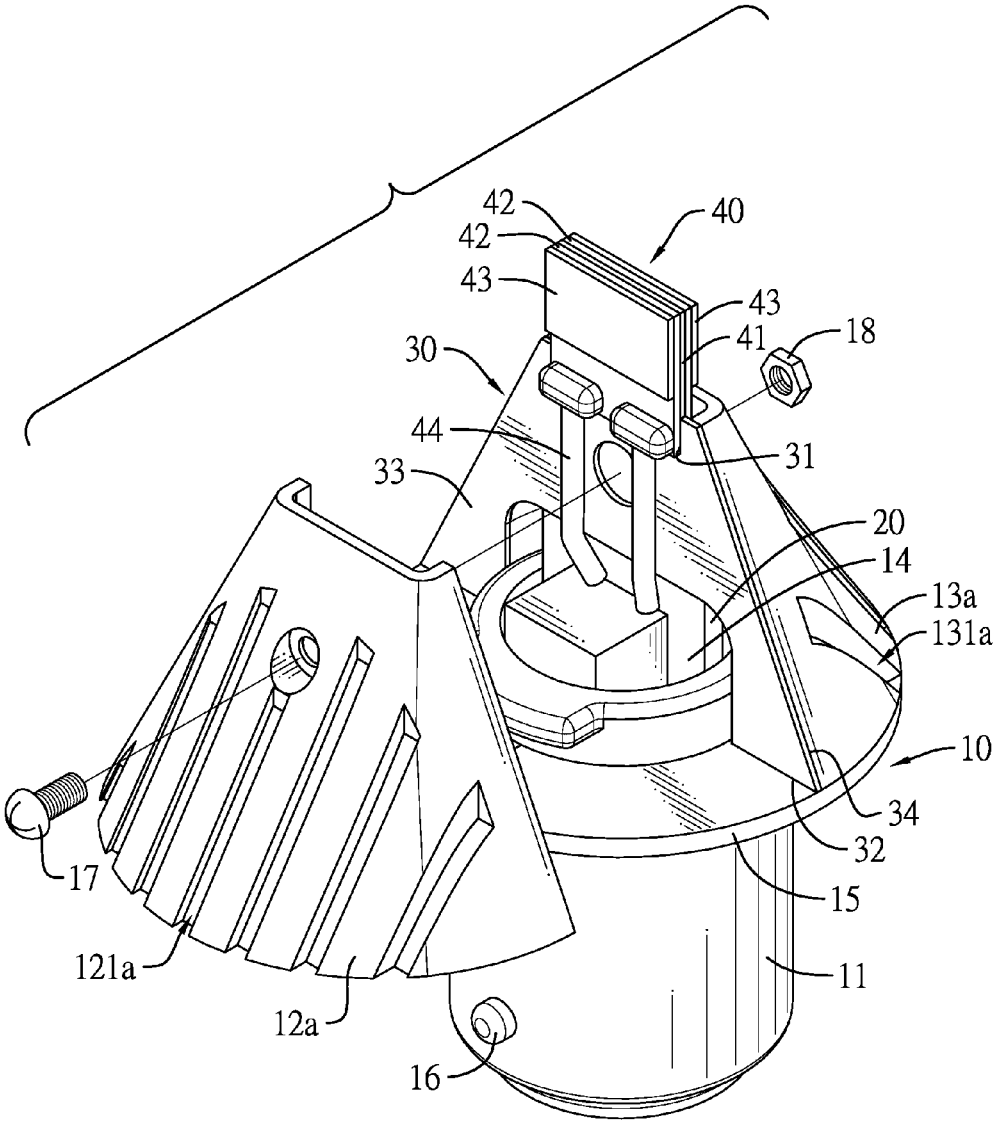
FIG. 5 is an exploded perspective view of a second embodiment of a lighting device in accordance with the present invention.

With reference to FIG. 5, each cap 12*a*, 13*a* has multiple cooling grooves 121*a*, 131*a* to increase the heat dissipating areas of the lighting device as described.

The lighting device is mounted on a lamp seat having a reflecting surface via the protrusions 16 of the base 10. A lampshade is mounted on the lamp seat. The LED module 40 of the lighting device is inserted into a reflection space around the lamp seat. The light emitted from the at least one LED 43 of the lighting device as described illuminates the reflector and is reflected by the reflecting surface to be emitted out from the lampshade.

Figure 4:
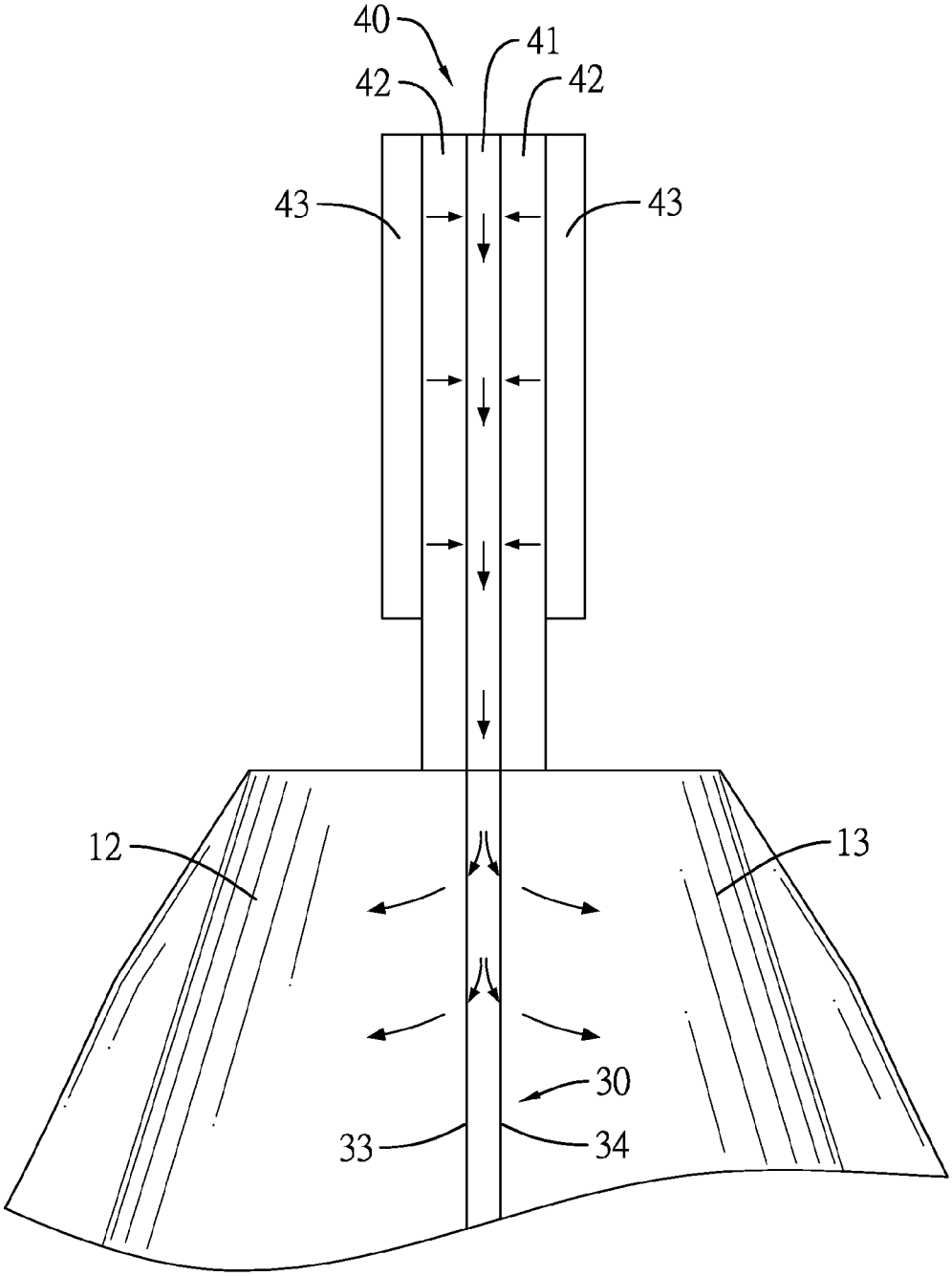
FIG. 4 is a side view in partial section of the lighting device in FIG. 2, showing two heat dissipating paths.

With reference to FIG. 4, the heat generated by the at least one LED 43 of the LED module 40 is conducted to the conducting rib 30 through the circuit board 42 and the heat-conducting plate 41 in sequence. The heat conducted to the conducting rib 30 is further conducted to the first cap 12 through the first heat-dissipating surface 33 to form a first heat dissipating path. At the same time, the heat conducted to the conducting rib 30 is further conducted to the second cap 13 through the second heat-dissipating surface 34 to form a second heat dissipating path. The heat conducted to the first cap 12 and the second cap 13 can be further dissipated by convection.

Accordingly, the conducting rib 30 of the lighting device as described provides two heat dissipating paths to increase the heat dissipating efficiency. Furthermore, the LED module 40 is mounted on the first end 31 of the conducting rib 30 to accurately correspond to a reflection space of a lamp seat of the vehicle lamp. The light emitted from the LED module 40 illuminates the reflecting surface of the lamp seat and is reflected by the reflecting surface to improve the light-homogenizing effect of the vehicle lamp. Therefore, the lighting device as described is in conformity with regulations of luminance and distribution of light pattern of vehicle lamps.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lighting device comprising:
a base;
a substrate mounted in the base;
a conducting rib perpendicularly mounted on the base and having
a first end;
a second end opposite to the first end and connected to the base;
a first heat-dissipating surface; and
a second heat-dissipating surface opposite to the first heat-dissipating surface; and
an LED module mounted on the first end of the conducting rib and extending out of the base, and electrically connected to the substrate.

2. The lighting device as claimed in claim 1, wherein the base has
a seat having an inner space to receive the substrate;
a loading portion mounted on and extending transversely from the seat and connected to the second end of the conducting rib;
a first cap mounted on the loading portion and connected to the first heat-dissipating surface of the conducting rib; and
a second cap mounted on the loading portion and connected to the second heat-dissipating surface of the conducting rib.

3. The lighting device as claimed in claim 2, wherein the base has
a screw inserted through the first cap, the conducting rib and the second cap; and
a nut screwed on the screw.

4. The lighting device as claimed in claim 2, wherein the first cap and the second cap both have multiple cooling grooves.

5. The lighting device as claimed in claim 3, wherein the first cap and the second cap both have multiple cooling grooves.

6. The lighting device as claimed in claim 1, wherein the LED module has
a heat-conducting plate mounted on the first end of the conducting rib and having two sides;
at least one circuit board mounted on one of the sides of the heat-conducting plate and electrically connected to the substrate; and
at least one LED mounted on and electrically connected to the at least one circuit board.

7. The lighting device as claimed in claim 2, wherein the LED module has
a heat-conducting plate mounted on the first end of the conducting rib and having two sides;
at least one circuit board mounted on one of the sides of the heat-conducting plate and electrically connected to the substrate; and
at least one LED mounted on and electrically connected to the at least one circuit board.

8. The lighting device as claimed in claim 3, wherein the LED module has
a heat-conducting plate mounted on the first end of the conducting rib and having two sides;
at least one circuit board mounted on one of the sides of the heat-conducting plate and electrically connected to the substrate; and
at least one LED mounted on and electrically connected to the at least one circuit board.

9. The lighting device as claimed in claim 4, wherein the LED module has
a heat-conducting plate mounted on the first end of the conducting rib and having two sides;
at least one circuit board mounted on one of the sides of the heat-conducting plate and electrically connected to the substrate; and
at least one LED mounted on and electrically connected to the at least one circuit board.

10. The lighting device as claimed in claim 5, wherein the LED module has
a heat-conducting plate mounted on the first end of the conducting rib and having two sides;
at least one circuit board mounted on one of the sides of the heat-conducting plate and electrically connected to the substrate; and
at least one LED mounted on and electrically connected to the at least one circuit board.

11. The lighting device as claimed in claim 7, wherein the base has multiple protrusions formed on an outer surface of the seat.

12. The lighting device as claimed in claim 8, wherein the base has multiple protrusions formed on an outer surface of the seat.

13. The lighting device as claimed in claim 9, wherein the base has multiple protrusions formed on an outer surface of the seat.

14. The lighting device as claimed in claim 10, wherein the base has multiple protrusions formed on an outer surface of the seat.

15. The lighting device as claimed in claim 2, wherein the lighting device has engaging units to assembly the first cap with the second cap.

16. The lighting device as claimed in claim 3, wherein the lighting device has engaging units to assembly the first cap with the second cap.

17. The lighting device as claimed in claim 4, wherein the lighting device has engaging units to assembly the first cap with the second cap.

* * * * *